US006857245B2

(12) United States Patent
Choi

(10) Patent No.: US 6,857,245 B2
(45) Date of Patent: Feb. 22, 2005

(54) BUILDING STRUCTURE

(76) Inventor: Young-Jun Choi, Duckshin Villa #201, 890-6, Bangbae-idong, Seocho-ku, Seoul City, 137-841 (KR)

( * ) Notice: Subject to any disclaimer, the term of this patent is extended or adjusted under 35 U.S.C. 154(b) by 32 days.

(21) Appl. No.: 10/296,460

(22) PCT Filed: Jun. 1, 2001

(86) PCT No.: PCT/KR01/00935

§ 371 (c)(1),
(2), (4) Date: Jul. 11, 2003

(87) PCT Pub. No.: WO01/94724

PCT Pub. Date: Dec. 13, 2001

(65) Prior Publication Data

US 2004/0020161 A1 Feb. 5, 2004

(30) Foreign Application Priority Data

Jun. 7, 2000 (KR) ..... 2000-31038
Jun. 8, 2000 (KR) ..... 2000-16160 U
May 30, 2001 (KR) ..... 2001-30202

(51) Int. Cl.[7] ..... B32B 1/05

(52) U.S. Cl. ..... 52/600; 52/79.1; 52/302.1; 40/427

(58) Field of Search ..... 52/600, 79.1, 79.4, 52/302.1, 171.3; 40/406, 409, 427; 119/257

(56) References Cited

U.S. PATENT DOCUMENTS 4,074,482 A * 2/1978 Klahr ..... 52/171.3
4,139,955 A * 2/1979 Reiback ..... 40/427
5,839,236 A * 11/1998 Frey ..... 52/235
6,253,499 B1 * 7/2001 Sidy ..... 52/79.1

FOREIGN PATENT DOCUMENTS

| | | |
|---|---|---|
| JP | 49-41860 | 9/1974 |
| JP | 61-78954 | 4/1986 |
| JP | 61-78955 | 4/1986 |
| JP | 63-76154 | 4/1988 |
| JP | 6-106899 | 4/1994 |

* cited by examiner

*Primary Examiner*—Carl D. Friedman
*Assistant Examiner*—Basil Katcheves
(74) *Attorney, Agent, or Firm*—Stites & Harbison PLLC; Ross F. Hunt, Jr.

(57) ABSTRACT

Disclosed is a building structure (1) formed with a living space available for our daily life therein, comprising a partition wall (25) partitioning the living space into a plurality of living sections (24); a wall assembly (20) including inner wall members made of transparent material, closing an outer circumference of the living space and meeting each living section (24), and outer wall members forming predetermined scene-production spaces (23), spacedly positioned relative to the inner wall members, corresponding to each living section (24); a supplying means for supplying a predetermined scene-producing object to inside of each scene-production space; and a controller (81) for activating and deactivating the supplying means so as to allow each of inner scene-production spaces to be produced independently. With this configuration, a predetermined scene can be dynamically produced by providing a scene-production space within a building structure and supplying solid objects and fluid to the scene-production space. In addition, several scenes as predetermined can be dynamically and sequentially produced in sequence within the same scene-production space.

10 Claims, 5 Drawing Sheets

PCT/KR01/00935

BUILDING STRUCTURE

FIELD OF THE INVENTION

The present invention relates to a building structure, and more particularly, to a building structure having a space in which a user is allowed to produce a scene as desired, the space being formed within a larger space available for our daily lives, and a predetermined scene is dynamically produced.

BACKGROUND ART

Buildings or houses have been developed to basically provide human beings with spaces for residence or living. In modern times, such buildings have been advanced in a various manner adaptively according to their use and purpose.

Rather than houses intended simply for residence, buildings used for commercial purposes (hereinafter, "commercial buildings) such as stores, restaurants, etc. are intended for inviting customers to enter therein. Taking this into consideration, it has been admitted that the commercial buildings are required for being decorated externally as well as internally, and they are to be functional enough to serve the convenience of the customers as much as possible. In order to bring about the decorativeness of the commercial buildings, there has been a growing tendency that the decoration is in a dynamic form rather than in a static form, with functional features.

DISCLOSURE OF THE INVENTION

Accordingly, the present invention has been made keeping in mind the above-described tendency in construction and building, and an object of the present invention is to provide a building structure having a space with which a user is allowed to dynamically produce and appreciate a scene therein as predetermined.

Another object of the present invention is to provide a building structure wherein predetermined scenes are dynamically and sequentially produced within the same space for producing the scenes.

These and other objects of the present invention may be accomplished by the provision of a building structure formed with a living space available for our daily life therein, comprising a partition wall partitioning the living space into a plurality of living sections, a wall assembly including inner wall members made of transparent material, closing an outer circumference of the living space and meeting each living section, and outer wall members forming predetermined scene-production spaces, spacedly positioned relative to the inner wall members, corresponding to each living section, a supplying means for supplying a predetermined scene-producing object to inside of each scene-production space, and a controller for activating and deactivating the supplying means so as to allow each of inner scene-production spaces to be produced independently.

Preferably, the scene-production space is partitioned into four scene-production spaces so as to allow the users to appreciate the four seasons.

Also preferably, the predetermined scene-producing object is supplied to each scene-production space so as to produce different seasons.

It is preferable that the predetermined scene-producing object is supplied to each scene-production space so as to produce four seasons as predetermined.

Desirably, the supplying means for supplying the scene-producing objects is comprised of a solid supplying device supplying solid objects into the scene-production space, and a fluid supplying device supplying fluid into the scene-production space.

Desirably, the solid supplying device is comprised of a blower, a solid storage for storing the solid objects therein, a solid inlet pipe connecting the blower and the solid storage, into which the solid objects are blown, a solid inlet valve provided in the solid inlet pipe, for flowing and interrupting the solid objects within the solid inlet pipe, a plurality of solid supplying pipes for supplying the solid objects to the scene-production space, and a plurality of solid blowing nozzles provided at terminal parts of the solid supplying pipe for blowing the solid objects into the scene-production spaces, wherein the blower is activated or deactivated for a predetermined period of time by the controller, and the solid inlet valve is activated to open or close the solid inlet pipe, in linkage with the blower by the controller.

Also desirably, the solid supplying device is further comprised of a solid distributing pipe for distributing the solid objects into each of the solid supplying pipe, and a plurality of solid supplying valves provided in the solid supplying pipes, for blowing and interrupting the solid objects within the solid supplying pipes, wherein the solid supplying valve is activated to open and close the solid supplying pipe by the controller so as to selectively supply the solid objects to the scene-production space.

Preferably, the fluid supplying device is comprised of a pump, a fluid storage storing the fluid therein, a fluid inlet pipe connecting the pump and the fluid storage, within which the fluid flows, a fluid inlet valve provided in the fluid inlet pipe, for flowing and interrupting the fluid within the fluid inlet pipe, a plurality of fluid supplying pipes supplying the fluid to the scene-production space, and a plurality of fluid flowing nozzles provided at terminal parts of the fluid supplying pipes for flowing the fluid into the scene-production space, wherein the pump is activated or deactivated for a predetermined period of time by the controller, and the fluid inlet valve is activated to open or close the fluid inlet pipe, in linkage with the pump by the controller.

It is desirable that the fluid supplying device is further comprised of a fluid distributing pipe for supplying the fluid in a distributed manner to the scene-production space, and a plurality of fluid flowing valves provided in the plurality of fluid supplying pipes, for flowing and interrupting the fluid within the fluid supplying pipes, and the fluid flowing valve is activated to open and close the fluid flowing pipe by the controller so as to selectively supply the fluid to the scene-production space.

Preferably, the fluid supplying device further comprises a plurality of fluid collector tubes for returning the fluid supplied to the scene-production space back to the fluid storage.

BRIEF DESCRIPTION OF DRAWINGS

The present invention will be better understood and its various objects and advantages will be more fully appreciated from the following description taken in conjunction with the accompanying drawings, in which.

MODES FOR CARRYING OUT THE INVENTION

The preferred embodiments of the present invention will be described in more detail with reference to the accompanying drawings.

Figure 1:
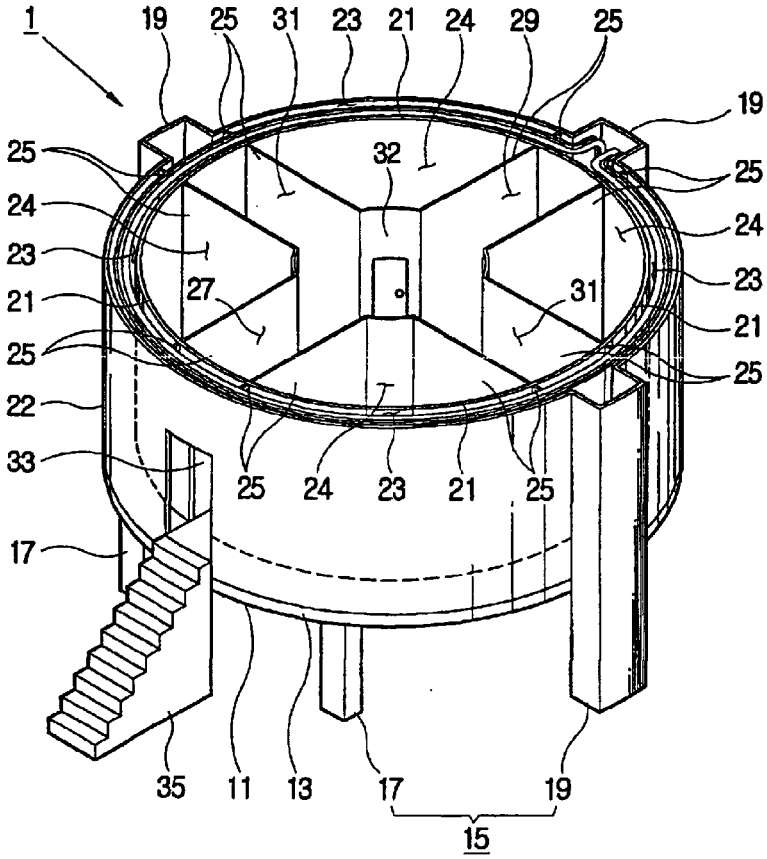
FIG. 1 is a schematic perspective view of a building structure having an opened top part according to the present invention.
Figure 2:
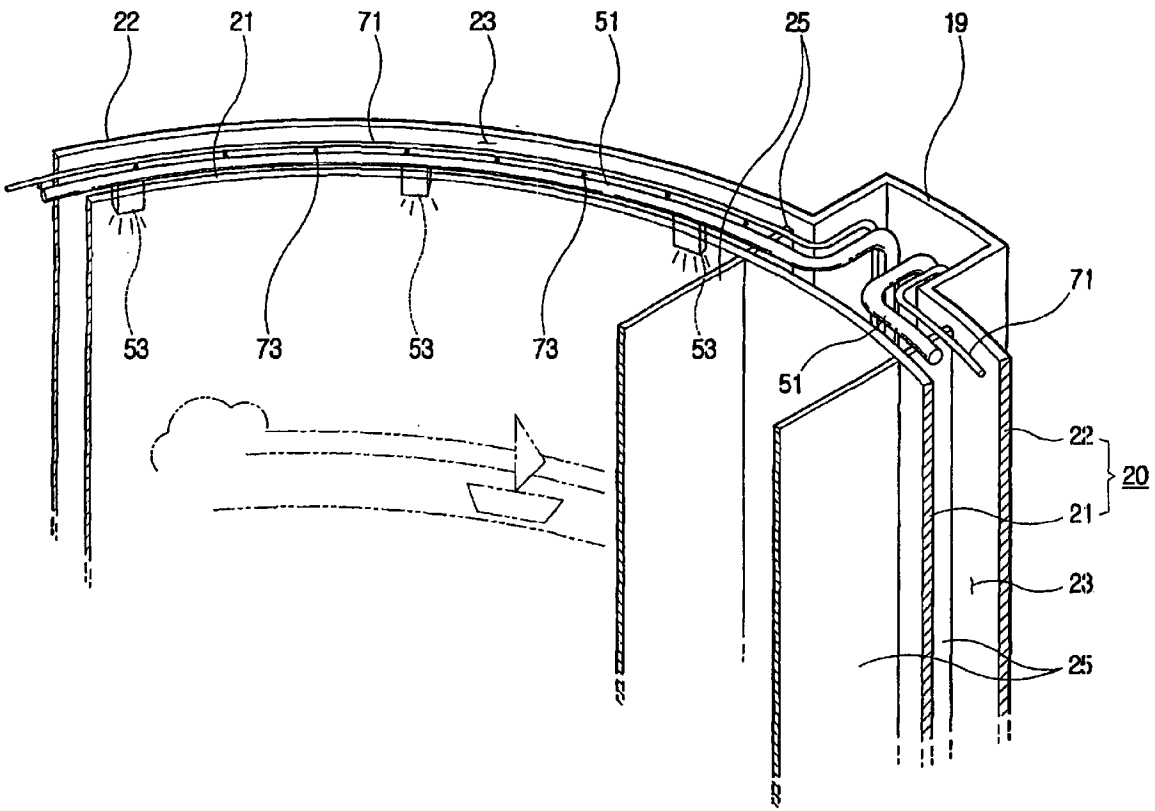
FIG. 2 is an enlarged perspective view showing a space for scene production of FIG. 1, a part of which is enlarged.
Figure 3:
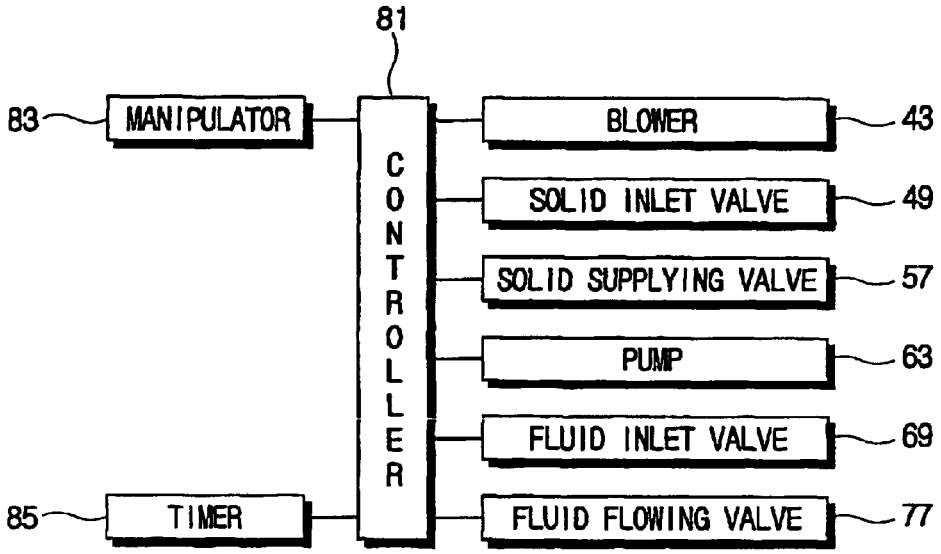
FIG. 3 is a control block diagram showing a scene production within a space for the scene production of FIG. 1.

FIG. 1 is a schematic perspective view of a building structure having an opened top part according to the present invention, FIG. 2 is an enlarged perspective view showing a space for scene production of FIG. 1, a part of which is enlarged, and FIG. 3 is a control block diagram showing a scene production within a space for the scene production of FIG. 1. Referring to these figures, a building structure 1 according to the present invention is comprised of a floor 11 mounted isolatedly from the ground, forming thereon an inner space available for our daily life (hereinafter referred to as "living space"), a supportive frame 15 supporting the floor 11, a plurality of partition walls 25 partitioning the living space into a plurality of sections 24 in which we are allowed to live our daily life (hereinafter referred to as "living section"), and a wall assembly 20 defining an outer appearance of the living space and circumferential in shape, the wall assembly 20 including inner wall members 21 made of transparent material, closing an outer circumference of the living space and meeting each living section, and outer wall members 22 forming spaces 23 of producing any of predetermined scenes (hereinafter referred to as "scene-production space"), spacedly displaced relative to the inner wall members 21, corresponding to each living section 24. Within each scene production scene are mounted a supplying means for supplying objects to be used for producing a scene (hereinafter referred to as "scene-producing objects"), and a controller 81 controlling the supplying means so as to produce a scene inside each scene-production space independently from the other scene-production spaces.

The floor 11 is circular in shape, and it is isolated from the ground to a predetermined distance of height, so as to secure a sufficient space to park vehicles below it.

On the top part of the floor 11 forming thereon a larger living space allowable for our daily life are installed the partition walls 25 partitioning the living space into the plurality of living sections 24 used to live our daily life, for example, four living sections 24. Between the living sections 24 are mounted intersecting or crossing passages or corridors 27, 29 and 31. Preferably, the passages denoted the reference numerals 27 and 29 are wider in breadth than the passage 31 so as to allow the passersby to pass over in a convenient manner, and to install a kitchen therein. The passages 27 and 29 may be utilized for a waiting room or a cocktail bar, etc. if a restroom is installed on the way of the passage 31.

On the bottom of the floor 11 is provided a machinery room 13 within which the solid and fluid supplying devices 41 and 61 to be described later as a supplying means for supplying scene-producing objects, a variety of devices for water supply and drain, power supply and air-conditioning, etc. are basically housed. The devices for water supply and drain, power supply and air-conditioning, etc. are some of the necessities of a building structure. As an alternative, the floor 11 may be in a rectangular form, unlike the circular form as illustrated, and the machinery room 13 may be provided on the top of the floor 11.

The supportive frame 15 comprises a plurality of front frames 17 installed in front of the floor 1 and a plurality of back frames 19 installed in back of the floor 11. Each front frame 17 is installed between the ground and the bottom face of the floor 1. Each back frame 19 whose one side is opened takes the hollow column shape. The back frames 19 are extended upward from the ground to the floor 11 and disposed along the edge of the floor 11 with a predetermined interval. Solid and fluid supplying pipes 51 and 71 for supplying the scene-production space 23 with solid objects and fluid, respectively, which will be described later, a variety of pipes and distributing wires, etc. are installed inside the back frame 19 so as to be concealed from the outside. A restroom may be constructed around the back frame 19 positioned on either end of a corridor denoted a reference numeral 31.

The wall assembly 20 upwardly provided along the edge of the floor 11 is comprised of the inner wall members 21 made of transparent material, closing an outer circumference of the living space and meeting each living section, and the outer wall members 22 forming the predetermined scene-production spaces, spacedly positioned relative to the inner wall members 21, corresponding to each living section 24. The scene-production space formed between the inner wall member 21 and the outer wall member 22 is divided by the partition walls 25 into the plurality of living sections 24, each of which constitutes an independent space. Preferably, the outer wall member 22 may be made of any of transparent material, semi-transparent material or opaque material. It is also preferable that the scene-production space 23 is divided into four sections corresponding to the living sections 24 so as to allow the users to appreciate four seasons produced therein. For example, the space for producing a season of Spring is decorated by means of flowers, etc., the space for producing Summer is decorated by means of sands, rocks, ships, etc., the space for producing Autumn is decorated by means of maple trees and leaves, etc., and the space for producing Winter is decorated by means of skies, snow boards, etc.

Each of the scene-production space 23 may be decorated with a geographically specific scene.

The scene-production space 23 has a predetermined width of gap so as to allow a person to come in and out for any operation required for the scene production, etc. as necessary, and the gap is preferably about 1 m.

Preferably, a supporter (not shown) is centrally provided between the inner wall member 21 and the outer wall member 22 so as to fix them.

In one side of the wall assembly 20 is provided an entrance 33 communicating with the passage 27, through which the users come in and out. The entrance 33 is communicated with a stairway 35 mounted outside the building, and the users can come in and out of the building through the entrance 33 over the stairway 35.

With this configuration, each living section dividedly formed by the partition wall 25 has its respective and independent scene-production space 24 therein.

According to the present invention, the building structure 1 further comprises a solid supplying device 41 supplying the solid objects to the scene-production space 23 and a fluid supplying device 61 supplying the fluid to the scene-production space 23, the solid supplying device 41 and the fluid supplying device 61 constituting a supplying means for supplying predetermined scene-producing objects into each scene-production space of the wall assembly 20.

Figure 4:
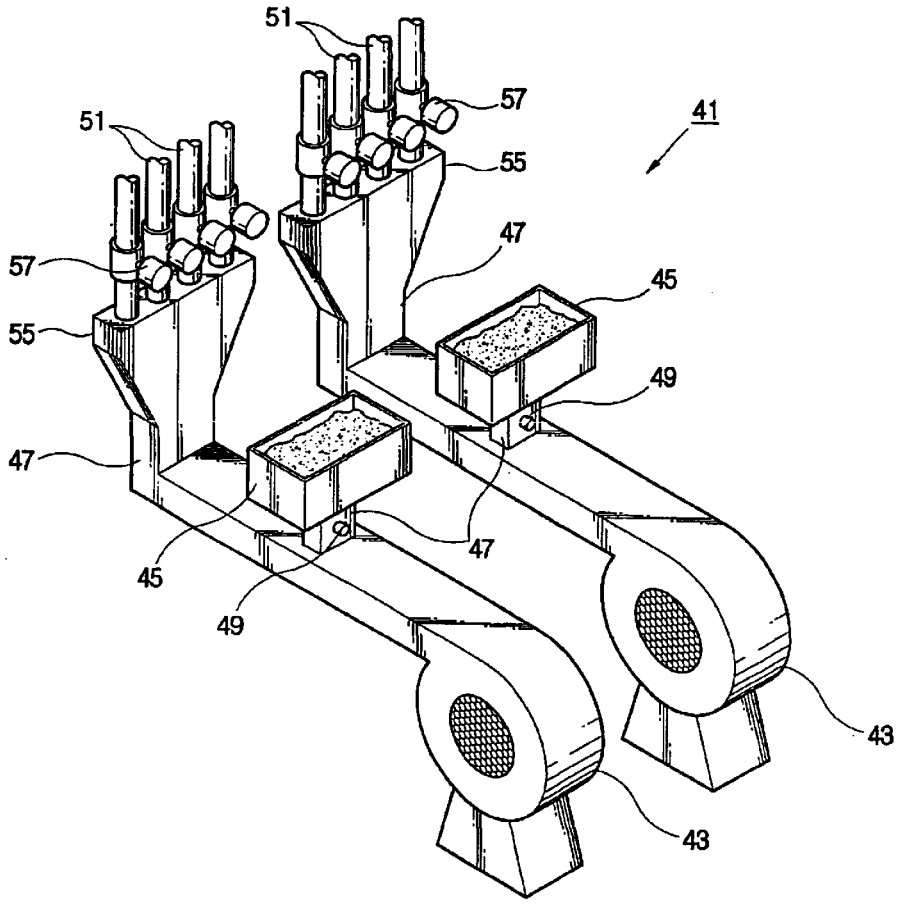
FIG. 4 is a schematic perspective view of a solid supplying device according to the present invention.

The solid supplying device 41 is, as depicted in FIG. 4, comprised of a blower 43 for supplying the solid objects, a solid storage 45 for storing the solid objects, a solid inlet pipe 47 connecting the blower 43 and the solid storage 45, into which the solid objects are blown, an inlet valve 49 provided in the solid inlet pipe 47, for blowing and interrupting the solid objects within the solid inlet pipe 47, a plurality of solid supplying pipes 51 for supplying the solid objects to each of the scene-production space 23, a plurality of solid blowing nozzles 53 provided in each terminal part of the solid supplying pipe 51 for blowing the solid objects into the scene-production spaces 23. Herein, the solid objects may be comprised of fallen leave molds made of plastic to produce the fallen leaves, broken pieces of polystyrene foam to produce snowflakes, etc. for way of example. Thus, it is preferable that outlet ports of the solid blowing nozzles 53 have relatively a wider diameter so as to allow such solid objects as fallen leave molds, etc. to pass therethrough and are disposed at wider intervals.

The solid supplying device 41 further includes a solid distributing pipe 55 for distributing the solid objects into each of the solid supplying pipes 51, and a plurality of solid supplying valves 57 provided in the solid supplying pipes 51, for blowing and interrupting the solid objects within the solid supplying pipes 51.

To the solid inlet valve 49 and the solid supplying valve 57 are respectively attached valve driver parts activated by a signal from a controller 81 to be described later.

The blower 43 is activated or deactivated for a predetermined period of time depending upon the signal from the controller 81, and the solid inlet valve 49 is activated to open or close the solid inlet pipe 47, in linkage with the blower 43 according to the signal from the controller 81. Each solid supplying valve 57 is activated to open or close each of the solid supplying pipes 51 so as to optionally supply the solid objects to each of the scene-production spaces 23 according to the signal from the controller 81.

Figure 5:
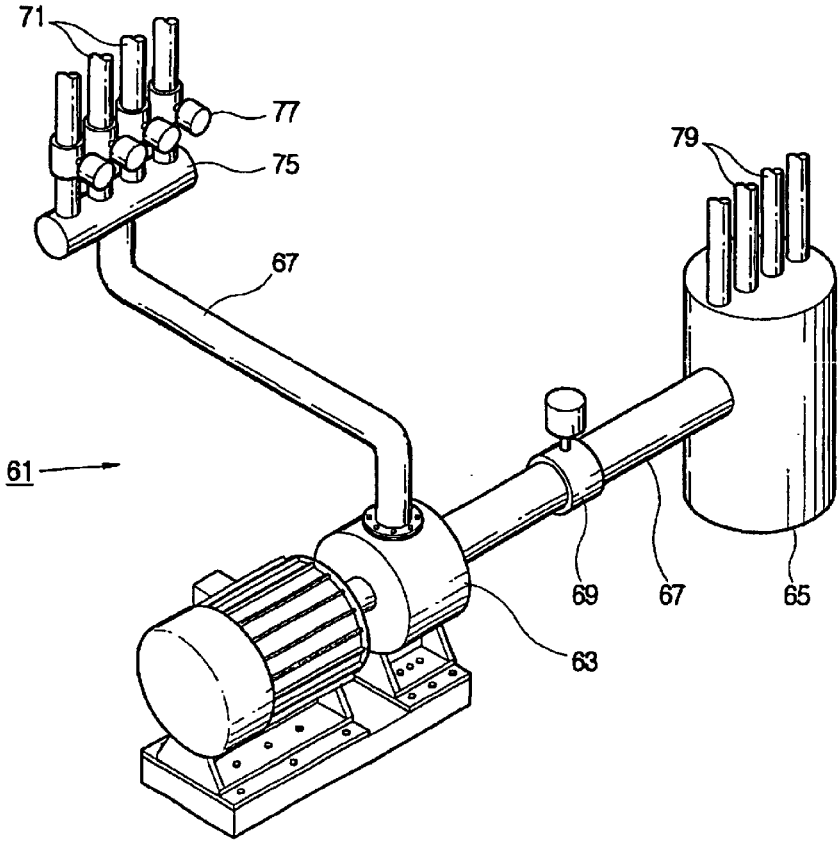
FIG. 5 is a schematic perspective view of a fluid supplying device according to the present invention.

The fluid supplying device 61 according to the present invention is, as illustrated in FIG. 5, comprised of a pump 63 for supplying the fluid, a fluid storage 65 storing the fluid therein, a fluid inlet pipe 67 connecting the pump 63 and the fluid storage 65, within which the fluid flows, a fluid inlet valve 69 provided in the fluid inlet pipe 67, for flowing and interrupting the fluid within the fluid inlet pipe 67, a plurality of fluid supplying pipes 71 supplying the fluid to each of the scene-production spaces 23, and a plurality of fluid flowing nozzles 73 provided in each terminal part of the fluid supplying pipe 71 for flowing the fluid into the scene-production spaces 23. Preferably, the fluid flowing nozzles 73 are displaced in a narrower manner than the solid blowing nozzles 53 so as to produce a raining scene.

The fluid supplying device 61 is further comprised of a fluid distributing pipe 75 for supplying the fluid in a distributed manner to the scene-production space 23, and a plurality of fluid flowing valves 77 provided in the plurality of fluid supplying pipes 71, for flowing and interrupting the fluid within the fluid supplying pipes 71. The fluid supplying device 61 further includes a plurality of fluid collector tubes 79 for returning the fluid supplied to the scene-production space 23 back to the fluid storage 65.

To the fluid inlet valve 69 and the fluid flowing valve 77 is respectively attached valve driver parts activated by a signal from the controller 81 to be described later.

The pump 63 is activated or deactivated for a predetermined period of time depending upon the signal from the controller 81, the fluid inlet valve 69 is activated to open or close the fluid inlet pipe 47, in linkage with the pump 63 according to the signal from the controller 81. Each fluid flowing valve 77 is activated to open or close each of the fluid supplying pipes 71 so as to optionally supply the fluid to each of the scene-production spaces 23 according to the signal from the controller 81.

The controller 81 activates or deactivates the blower 43 and the pump 63 according to the signal from a manipulator 83 manipulated by the user, and controls the blower 43 and the pump 63 to be activated or deactivated for a predetermined period of time according to the signal from a timer 85. The controller 81 transmits to the solid inlet valve 49 and the fluid inlet valve 69 a signal to open the solid inlet pipe 47 and the fluid inlet pipe 67 while the blower 43 and the pump 63 are in operation. Also, the controller 81 transmits to the solid inlet valve 49 and the fluid inlet valve 69 a signal to close the solid inlet pipe 47 and the fluid inlet pipe 67 while the blower 43 and the pump 63 are in no operation. The controller 81 transmits to the solid supplying valve 55 and the fluid flowing valve 77 a signal to open them, those which are selected to open the fluid supplying pipe 51 and the fluid flowing pipe 71 selected for selectively supplying the solid objects and the fluid to a predetermined scene-production space.

With this configuration, solid objects of different kind, for example, fallen leave molds and broken pieces of polystyrene foam, are separately stored in their respective solid storages 45 and fluid, typically water, is stored in the fluid storage 65. The user operates the manipulator 83 so as to differentiate each of the scene-production spaces 23 in seasons, that is, Spring, Summer, Autumn and Winter. In response to the signal from the manipulator 83, the controller 81 transmits a signal to activate the blower 43 and the pump 63 according to the characteristics of each scene-production space 23, and at the same time, activates the blower 43 and the pump 63 for a predetermined of time based on the signal from the timer 85. In response to the signal to activate the blower 43 and the pump 63, the controller 81 transmits to the solid supplying valve 49 and the fluid flowing valve 69 a signal to activate them to open the solid supplying pipe 47 and the fluid flowing pipe 67. The controller 81 transmits to the solid supplying valve 55 and the fluid flowing valve 75 provided in the solid supplying pipe 51 and the fluid flowing pipe 71 an signal to activate them, those which are selected so as to selectively supply the solid objects and the fluid according to the characteristics of each scene-production space 23, thereby opening the selected fluid supplying pipe 51 and the selected fluid flowing pipe 71.

When each blower 53 is operated, the fallen leave molds and the broken pieces of Polystyrene foam stored in their respective solid storages 45 are blown to reach each of the solid distributing pipes 55, along with air emitted by the blower 43. When the pump 63 is operated, the water discharged by the pump 63 reaches the fluid distributing pipe 75.

The fallen leave molds and the broken pieces of polystyrene foam reaching each solid distributing pipe 55 are respectively supplied to the scene-production space 23 as predetermined, through the solid supplying pipe 51 selected to be opened, and are dropped into the scene-production space 23 along with the air through the solid supplying nozzle 53. Thus, the fallen leave molds drop like fallen leaves within the scene-production space 23 to thereby produce the season of Autumn, and the broken pieces of polystyrene foam drop like snowflakes within the scene-production space to thereby produce the season of Winter. The water reaching the fluid distributing pipe 75 is supplied to the predetermined scene-production space 23 through the opened fluid supplying pipe 71, and is sprayed within the scene-production space 23 through the fluid flowing nozzle 73. Thus, the scene-production space 23 within which the water is sprayed has a raining image in Spring or Summer.

When the water collected within the scene-production space 23 is in excess of a predetermined level of water, it starts to be discharged and returned back to the fluid storage 65 through the fluid collector pipe 79, and thereby, the water is repeatedly circulated. The fallen leave molds and the broken pieces of polystyrene foam collected within the scene-production spaces 23 are removed by the user in a periodical manner and then stored in each of the solid storages 45 so as to be re-used.

According to the present invention as described above, at least a season can be dynamically produced for appreciation by the customers by supplying the solid objects and the fluid to each scene-production space 23.

The user may operate the manipulator 83 so as to supply both fallen leave molds and water to a predetermined scene-production space 23. If then, the solid supplying device 41 and the fluid supplying device 61 are both controlled by the controller 81, and a raining scene with the fallen leaves being dropped is produced in the predetermined scene-production space 23.

As in the above, a variety of scenes can be produced in the scene-production space 23.

That is, the user may also operate the manipulator 83 so as to supply fallen leave molds, broken pieces of polystyrene foam and water in sequence to the same scene-production space 23. If then, the solid supplying device 41 and the fluid supplying device 61 are sequentially controlled by the controller 81, and the fallen leave moles, broken pieces of Polystyrene foam and water are supplied in sequence for a predetermined time, to thereby allow the user to produce and appreciate a scene showing continuously the four seasons within a space.

As described above, a predetermined scene can be dynamically produced by providing a scene-production space within a living space and supplying scene-producing objects to the scene-production space. In addition, several scenes as determined can be dynamically and sequentially produced in sequence within the same scene-production space.

Although it has not been shown in the above-described embodiments, the roof of the building structure can be made of any of transparent, opaque or semi-transparent material. Typically, the transparent material includes glass. In case which the building structure is covered with the transparent roof, a shield cover to appropriately block ultraviolet rays may be mounted.

In the preferred embodiment described above, the floor of the building structure is spacedly installed from the ground, but it may be mounted on the ground.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A building structure formed with a living space available for our daily life therein, comprising:

a partition wall partitioning the living space into a plurality of living sections;

a wall assembly including inner wall members made of transparent material, closing an outer circumference of the living space and meeting each living section, and outer wall members forming predetermined scene-production spaces, spacedly positioned relative to the inner wall members, corresponding to each living section;

a supplying means for supplying a predetermined scene-producing object to inside of each scene-production space; and a controller for activating and deactivating the supplying means so as to allow each of inner scene-production spaces to be produced independently.

2. The building structure according to claim 1, wherein the scene-production space is partitioned into four scene-production spaces so as to allow the users to appreciate the four seasons.

3. The building structure according to claim 2, wherein the predetermined scene-producing object is supplied to each scene-production space so as to produce different seasons.

4. The building structure according to claim 2, wherein the predetermined scene-producing object is supplied to each scene-production space so as to produce four seasons as predetermined.

5. The building structure according to claim 1, wherein the supplying means for supplying the scene-producing objects is comprised of a solid supplying device supplying solid objects into the scene-production space; and a fluid supplying device supplying fluid into the scene-production space.

6. The building structure according to claim 5, wherein the solid supplying device is comprised of:

a blower, a solid storage for storing the solid objects therein, a solid inlet pipe connecting the blower and the solid storage, into which the solid objects are blown, a solid inlet valve provided in the solid inlet pipe, for flowing and interrupting the solid objects within the solid inlet pipe, a plurality of solid supplying pipes for supplying the solid objects to the scene-production space, and a plurality of solid blowing nozzles provided at terminal parts of the solid supplying pipe for blowing the solid objects into the scene-production spaces, wherein the blower is activated or deactivated for a predetermined period of time by the controller, and the solid inlet valve is activated to open or close the solid inlet pipe, in linkage with the blower by the controller.

7. The building structure according to claim 6, wherein the solid supplying device is further comprised of:

a solid distributing pipe for distributing the solid objects into each of the solid supplying pipe, and a plurality of solid supplying valves provided in the solid supplying pipes, for blowing and interrupting the solid objects within the solid supplying pipes, wherein the solid supplying valve is activated to open and close the solid supplying pipe by the controller so as to selectively supply the solid objects to the scene-production space.

8. The building structure according to claim 5, wherein the fluid supplying device is comprised of:

a pump, a fluid storage storing the fluid therein, a fluid inlet pipe connecting the pump and the fluid storage, within which the fluid flows, a fluid inlet valve provided in the fluid inlet pipe, for flowing and interrupting the fluid within the fluid inlet pipe, a plurality of fluid supplying pipes supplying the fluid to the scene-production space, and a plurality of fluid flowing nozzles provided at terminal parts of the fluid supplying pipes for flowing the fluid into the scene-production space, wherein the pump is activated or deactivated for a predetermined period of time by the controller, and the fluid inlet valve is activated to open or close the fluid inlet pipe, in linkage with the pump by the controller.

9. The building structure according to claim 8, wherein the fluid supplying device is further comprised of:

a fluid distributing pipe for supplying the fluid in a distributed manner to the scene-production space, and a plurality of fluid flowing valves provided in the plurality of fluid supplying pipes, for flowing and interrupting the fluid within the fluid supplying pipes, and the fluid flowing valve is activated to open and close the fluid flowing pipe by the controller so as to selectively supply the fluid to the scene-production space.

10. The building structure according to claim 9, wherein the fluid supplying device further comprises a plurality of fluid collector tubes for returning the fluid supplied to the scene-production space back to the fluid storage.

* * * * *